US007969365B2

(12) United States Patent
Asraff et al.

(10) Patent No.: US 7,969,365 B2
(45) Date of Patent: Jun. 28, 2011

(54) BOARD-TO-BOARD RADIO FREQUENCY ANTENNA ARRANGEMENT

(75) Inventors: Yechiel Asraff, Modi'in (IL); Shuki Levy, Ramat Gan (IL); Michael Nikolaevsky, Holon (IL); Haim Tzfati, Rishon Le Zion (IL)

(73) Assignee: Symbol Technologies, Inc., Holtsville, NY (US)

( * ) Notice: Subject to any disclaimer, the term of this patent is extended or adjusted under 35 U.S.C. 154(b) by 397 days.

(21) Appl. No.: 12/332,546

(22) Filed: Dec. 11, 2008

(65) Prior Publication Data

US 2010/0149041 A1 Jun. 17, 2010

(51) Int. Cl.
*H01Q 1/24* (2006.01)

(52) U.S. Cl. ..... 343/702

(58) Field of Classification Search ..... 343/702, 343/853, 700 MS; 342/372–375, 70
See application file for complete search history.

(56) References Cited

U.S. PATENT DOCUMENTS

| | | | | |
|---|---|---|---|---|
| 7,348,932 | B1 * | 3/2008 | Puzella et al. | 343/853 |
| 7,518,560 | B2 * | 4/2009 | Hung et al. | 343/702 |
| 7,671,696 | B1 * | 3/2010 | Puzella et al. | 333/33 |
| 7,729,131 | B2 * | 6/2010 | Wang et al. | 361/818 |
| 2004/0150562 | A1 | 8/2004 | Paun | |
| 2008/0074324 | A1 * | 3/2008 | Puzella et al. | 343/700 MS |
| 2008/0165517 | A1 * | 7/2008 | Wang et al. | 361/800 |

* cited by examiner

*Primary Examiner* — Huedung Mancuso

(57) ABSTRACT

A radio frequency (RF) antenna arrangement for an electronic device includes a conductive ground reference element formed on a first circuit board, and a conductive antenna radiating element formed on a second circuit board. The two boards are coupled together such that the conductive ground reference element and the conductive antenna radiating element are facing each other. The RF antenna arrangement also includes a conductive radiating leg element for the conductive antenna radiating element, an electrical contact pin mounted on the first circuit board, and a conductive ground leg element that electrically couples the conductive antenna radiating element to the conductive ground reference element. The electrical contact pin is in physical and electrical contact with the conductive radiating leg element, and the electrical contact pin facilitates RF signal transmission to and from the conductive radiating leg element.

20 Claims, 9 Drawing Sheets

BOARD-TO-BOARD RADIO FREQUENCY ANTENNA ARRANGEMENT

TECHNICAL FIELD

Embodiments of the subject matter described herein relate generally to radio frequency (RF) antennas. More particularly, embodiments of the subject matter relate to an RF antenna arrangement suitable for use with a wireless electronic device such as a mobile communication device.

BACKGROUND

Computers, portable computing devices, and mobile wireless devices are becoming common appliances in homes, offices, medical facilities, schools, manufacturing plants, and elsewhere. Wireless data communication with such devices and computer networks is becoming increasingly common. Wireless data communication requires data transmission in accordance with a specific data communication protocol, a wireless transceiver, and a suitable antenna structure configured to transmit and receive signals, typically via an RF data communication link.

The prior art is replete with RF and microwave antenna designs, structures, and configurations. Some mobile wireless devices, such as cellular telephones or mobile computing devices, employ external antennas that protrude or extend from the main housings of the devices. Other wireless devices utilize internal antennas that reside within the confines of the main housings. Internal antennas are often used to achieve a compact footprint and to protect the antenna itself from physical damage. The trend toward miniaturization has made compact antennas very desirable. Moreover, mobile device applications typically require a relatively rugged and robust antenna design that can withstand rough handling, impacts (caused by dropping or accidents), and the like.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
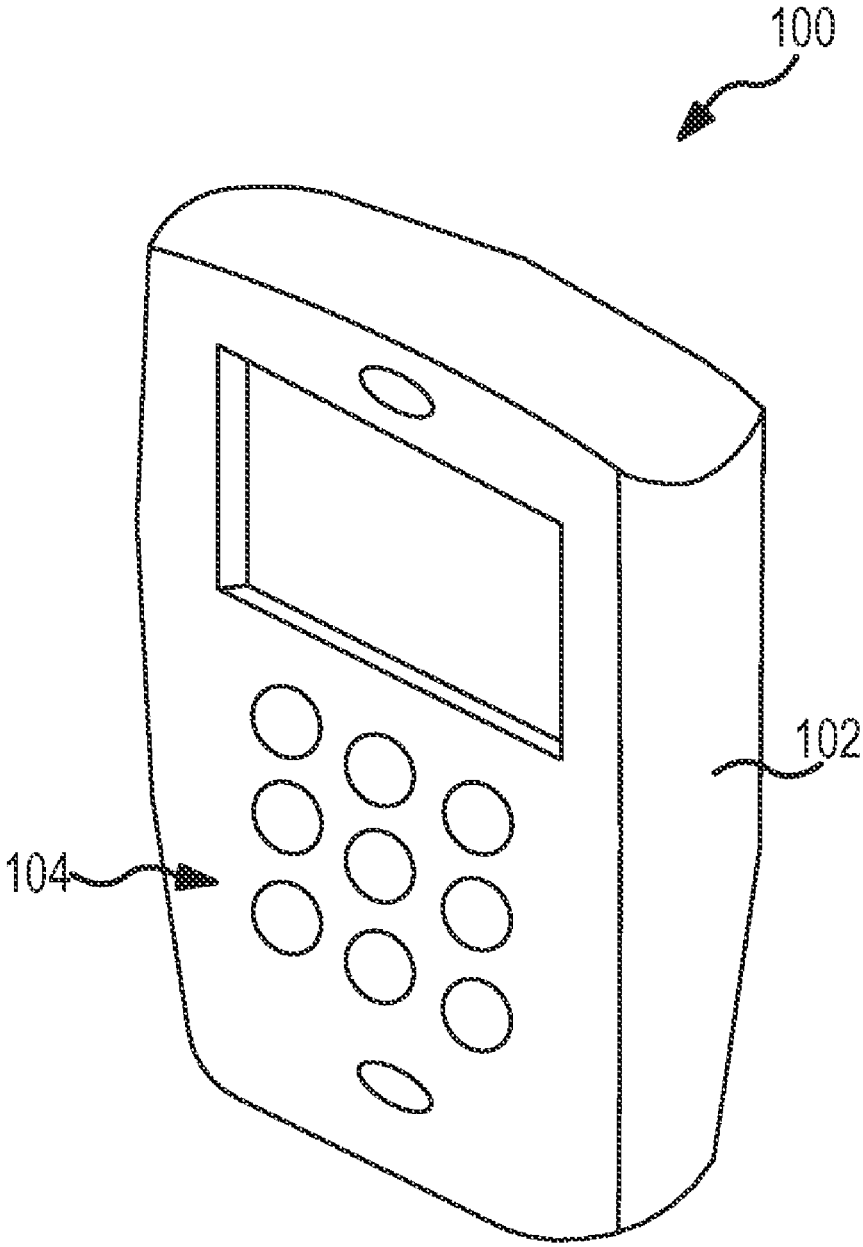
FIG. 1 is a perspective view of an exemplary electronic device that includes an RF antenna structure (hidden from view)

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The following description may refer to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically.

In addition, certain terminology may also be used in the following description for the purpose of reference only, and thus are not intended to be limiting. For example, terms such as "upper", "lower", "above", and "below" refer to directions in the drawings to which reference is made. Terms such as "front", "back", "rear", "side", "outboard," and "inboard" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

The electronic devices described herein support wireless communication using a suitably configured RF antenna arrangement. The antenna arrangement utilizes conductive metal traces formed on two circuit boards, which are coupled together in a "sandwich" configuration. The antenna arrangement includes an inverted-F antenna structure that uses a conductive radiating element formed on one of the two circuit boards and a conductive ground reference element formed on the other circuit board. The antenna structure utilizes a conductive contact element (e.g., a metal tab) rather than a coaxial cable for board-to-board connectivity. This arrangement eliminates cable losses and improves the efficiency of the antenna. The improvement in performance is a direct result of using the conductive contact as one leg of the inverted-F antenna.

The conductive contact element can be soldered or otherwise attached to the conductive radiating element by machine, rather than by hand. This reduces the assembly time and manufacturing cost associated with the fabrication of the electronic device. Moreover, the inverted-F antenna arrangement consumes less space than traditional designs that require external elements and/or coaxial cable connections.

FIG. 1 is a perspective view of an exemplary electronic device 100 that includes an internal RF antenna structure (hidden from view). Electronic device 100 may be designed and configured to suit the needs of the particular application. In this regard, electronic device 100 may be, without limitation: a cellular telephone; a personal digital assistant; a mobile computing device; a digital media player; a mobile video game device; or the like. Electronic device 100 includes a main housing 102 that surrounds and protects the internal components and circuit boards of electronic device 100. Electronic device 100 may also include a keypad 104 (or other user interface features) that is accessible from the exterior of main housing 102. Although not shown in FIG. 1, keypad 104 includes or cooperates with a suitably configured circuit board that is contained within main housing 102. This keypad circuit board accommodates the buttons or keys of keypad 104, and provides electrical paths from keypad 104 to a main or primary circuit board of electronic device 100, which is also enclosed by main housing 102.

Figure 2:
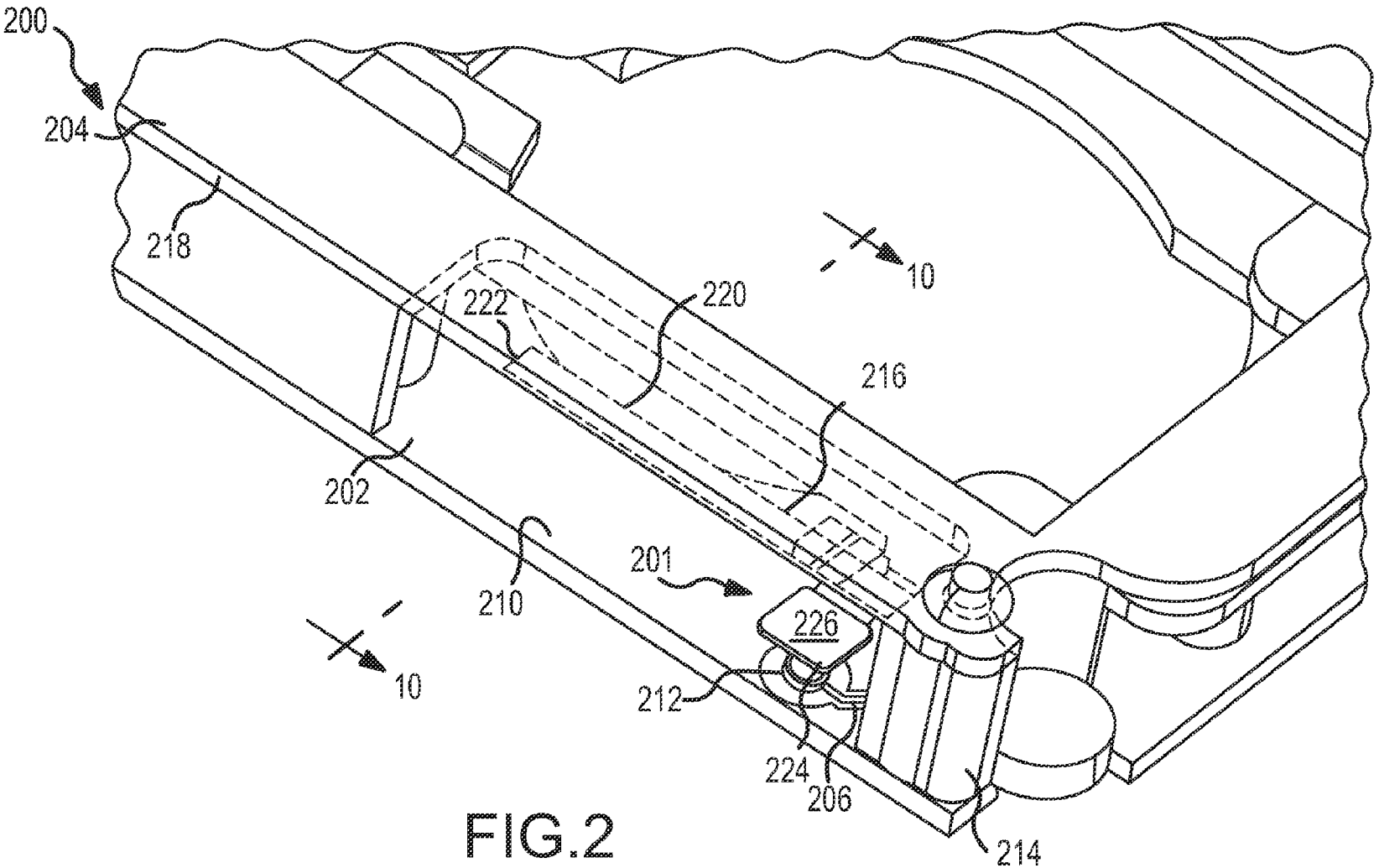
FIG. 2 is a perspective and partially phantom view of internal structure of an exemplary electronic device.
Figure 3:
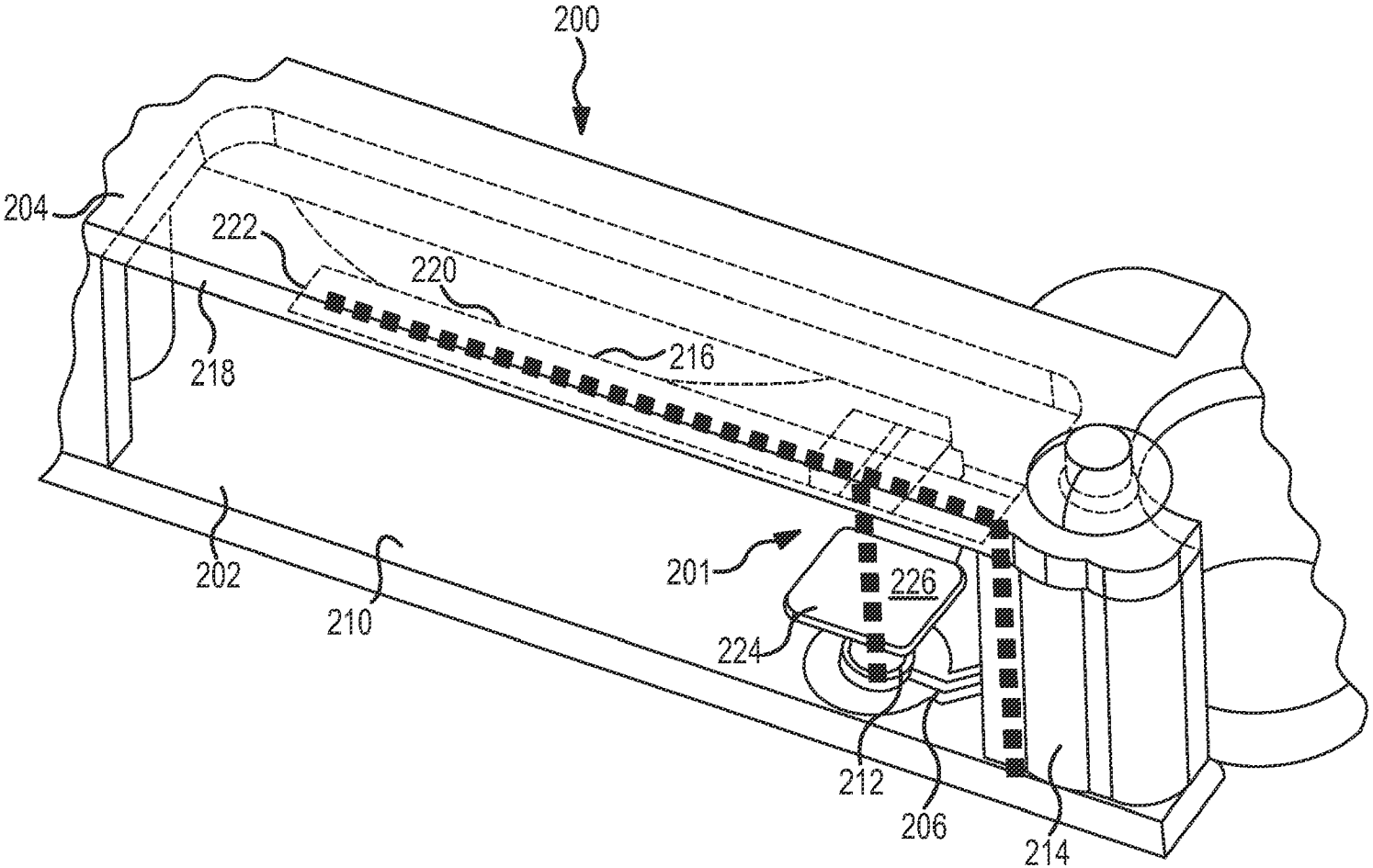
FIG. 3 is a perspective and partially phantom view of an exemplary embodiment of an inverted-F antenna structure for an electronic device.
Figure 4:
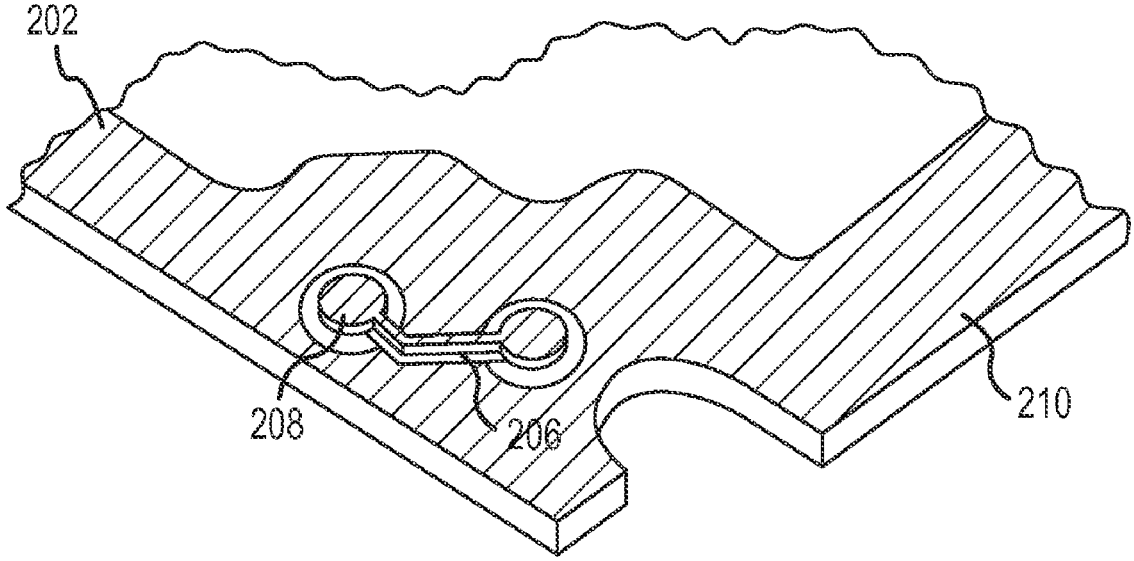
FIG. 4 is a perspective view of a portion of a primary circuit board suitable for use with an exemplary embodiment of an antenna structure.
Figure 5:
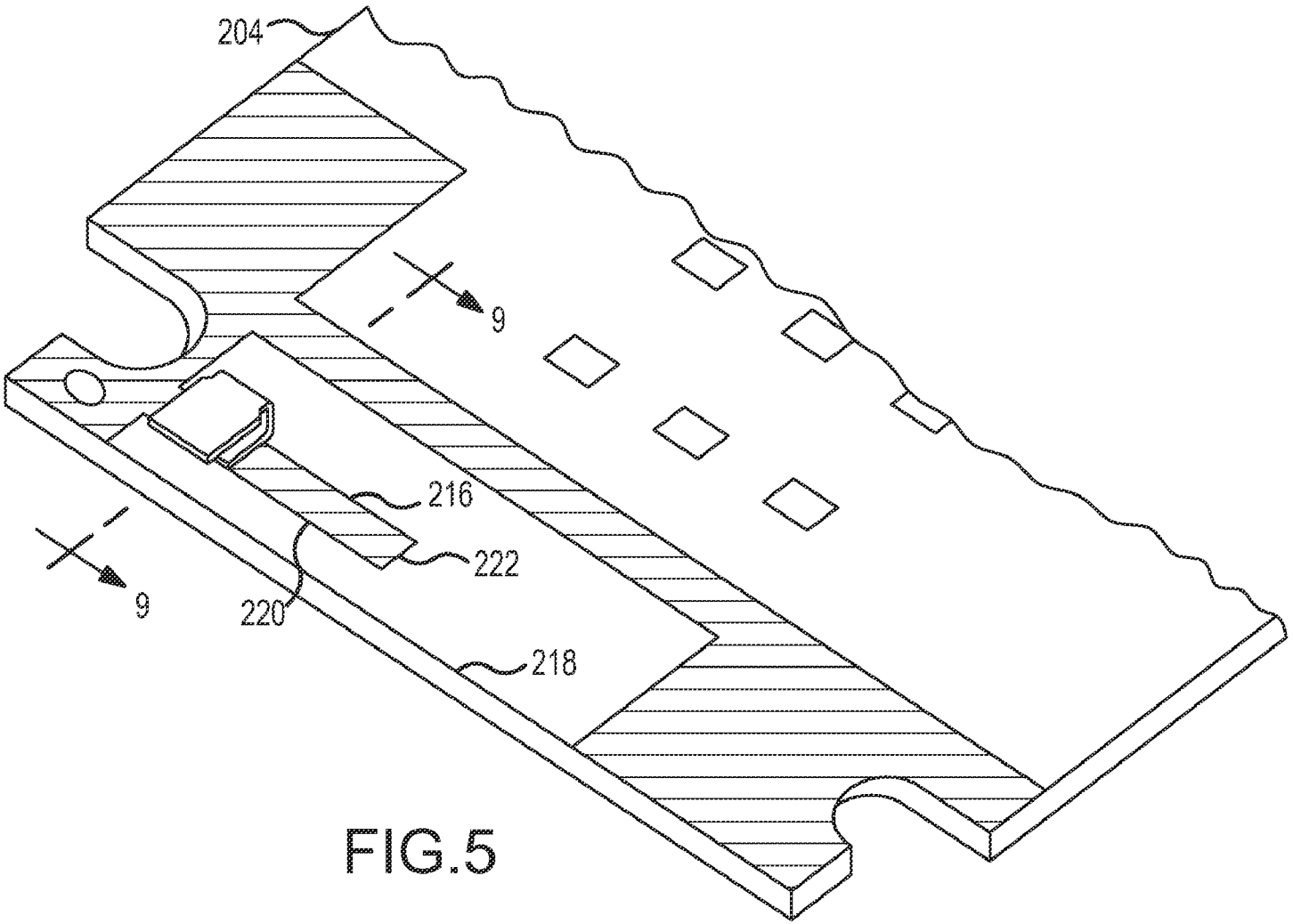
FIG. 5 is a perspective view of a portion of a secondary circuit board suitable for use with an exemplary embodiment of an antenna structure.
Figure 6:
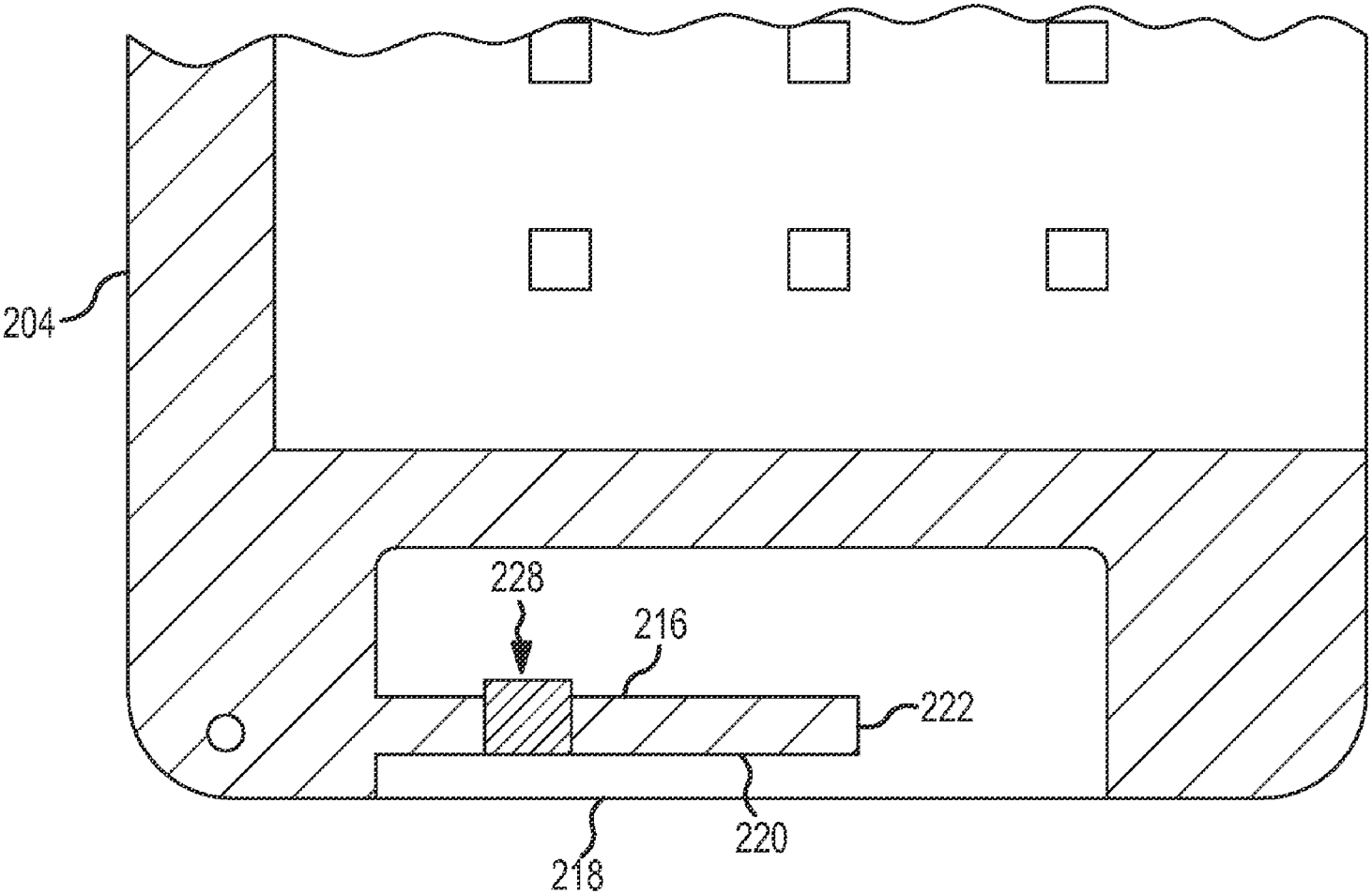
FIG. 6 is a top view of a portion of the secondary circuit board shown in FIG. 5.

Although hidden from view in FIG. 1, electronic device 100 includes an RF antenna arrangement and structure that supports wireless communication in accordance with the desired data communication protocol(s) and using the desired frequency band(s). For example, the RF antenna arrangement may be suitably configured to support Bluetooth compatible communication (which uses the 2400-2483.5 MHz band in Europe and the United States). FIG. 2 is a perspective and partially phantom view of internal structure of an exemplary electronic device 200 that includes an internal RF antenna arrangement 201, a primary circuit board 202, and a secondary circuit board 204. FIG. 3 is a perspective and partially phantom view of an inverted-F antenna structure for electronic device 200, FIG. 4 is a perspective view of a portion of primary circuit board 202, FIG. 5 is a perspective view of a portion of secondary circuit board 204, and FIG. 6 is a top view of a portion of secondary circuit board 204. For the sake of brevity, conventional techniques related to wireless data transmission, RF antenna design, RF antenna tuning and impedance matching, wireless electronic device design, manufacturing, and operation, and other functional aspects of the devices (and the individual operating components of the devices) may not be described in detail herein.

This particular embodiment of RF antenna arrangement 201 includes: a conductive antenna radiating element 216 formed on secondary circuit board 204; a conductive radiating leg element 224 attached to radiating element 216; an electrical contact pin 212 mounted on primary circuit board 202; a conductive mounting leg 214; and a conductive ground reference element 210 formed on primary circuit board 202. These fundamental elements and features form, or are otherwise associated with, an inverted-F antenna structure for electronic device 200. The dashed lines in FIG. 3 depict this inverted-F structure—conductive mounting leg 214 corresponds to the grounded leg (or the top of the letter F), radiating leg element 224 and electrical contact pin 212 together correspond to the RF feed leg, and radiating element 216 connects the grounded leg and the RF feed leg.

For this embodiment, primary circuit board 202 represents the main or basic circuit board of electronic device 200, and secondary circuit board 204 represents the keypad circuit board of electronic device 200. In alternate embodiments, the form, configuration, and/or function of these circuit boards may differ from that described here. Primary circuit board 202 may be realized as a printed circuit board having a dielectric layer or substrate and a conductive layer (e.g., metal) printed on the dielectric layer. In practice, primary circuit board 202 may be manufactured using any suitable construction, such as an FR-4, ceramic, or other substrate. The conductive layer resides on the inward-facing surface of primary circuit board 202. In other words, the conductive layer of primary circuit board 202 faces secondary circuit board 204. The conductive layer of primary circuit board 202 is etched or otherwise treated to create a desired pattern of conductive features. For example, the conductive layer is preferably formed such that it has defined therein an RF signal transmission line 206, a tab 208 (see FIG. 4), and a ground reference element 210 that is isolated from RF signal transmission line 206.

RF signal transmission line 206 is preferably realized as a microstrip transmission line that is formed in primary circuit board 202. RF signal transmission line 206 facilitates RF signal propagation to and from RF antenna arrangement 201 in a manner that does not interfere with the radiation pattern of RF antenna arrangement 201. In other words, little or no RF energy is radiated from RF signal transmission line 206. Although not depicted in the figures, RF signal transmission line 206 leads to a suitably configured RF front end of electronic device 200 that performs transmit and receive functions in a conventional manner.

As shown in FIG. 4, RF signal transmission line 206 ends at tab 208, which is used to mount an electrical contact pin 212 for RF antenna arrangement 201. This electrical contact pin 212 is described in more detail below. RF signal transmission line 206 is separated from ground reference element 210, as depicted in FIG. 4. In practice, a portion of the conductive layer of primary circuit board 202 is removed such that a gap is formed between ground reference element 210 and RF signal transmission line 206. In this particular embodiment, the dielectric material underneath RF signal transmission line 206 and underneath ground reference element 210 remains intact, but the dielectric material located between RF signal transmission line 206 and ground reference element 210 is removed.

Figure 10:
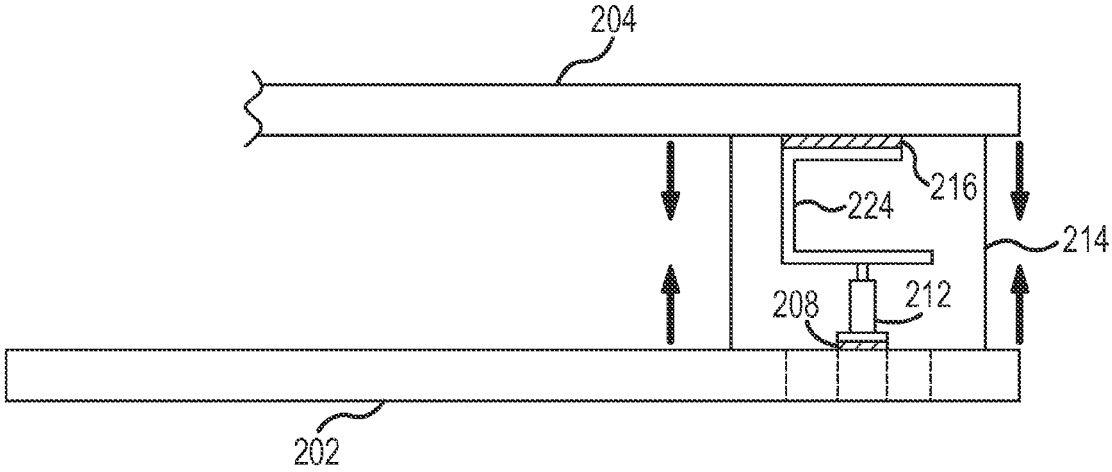
FIG. 10 is a cross sectional view of a portion of the electronic device as viewed from line 10-10 shown in FIG. 2.

Notably, ground reference element 210 corresponds to the chassis ground of electronic device 200. The chassis ground may be established by connecting appropriate terminals of electrical components to ground reference element 210 and/or to conductive housing structure of electronic device 200. For example, ground reference element 210 may be electrically coupled to at least one conductive mounting leg 214 (also referred to herein as a conductive ground leg element) that physically couples primary circuit board 202 to secondary circuit board 204. As shown in FIGS. 2, 3, and 10, conductive mounting leg 214 serves as a physical spacer or standoff between primary circuit board 202 and secondary circuit board 204, and conductive mounting leg 214 is located between the two circuit boards.

Secondary circuit board 204 may also be realized as a printed circuit board having a dielectric layer or substrate and a conductive layer (e.g., metal) printed on the dielectric layer. In practice, secondary circuit board 204 may be manufactured using any of the constructions mentioned above for primary circuit board 202. The conductive layer resides on the inward-facing surface of secondary circuit board 204. In other words, the conductive layer of secondary circuit board 204 faces primary circuit board 202. The conductive layer of secondary circuit board 204 is etched or otherwise treated to create a desired pattern of conductive features. For example, the conductive layer is preferably formed such that it has defined therein a conductive antenna radiating element 216. This conductive layer is also formed such that conductive mounting leg 214 can establish electrical contact with antenna radiating element 216. In other words, conductive mounting leg 214 electrically couples antenna radiating element 216 to ground reference element 210 (as depicted in FIG. 3) via physical contact between the upper and lower surfaces of conductive mounting leg 214 and respective conductive traces formed on primary circuit board 202 and secondary circuit board 204.

As best shown in FIG. 5 and FIG. 6, secondary circuit board 204 terminates at an outer edge 218, and antenna radiating element 216 includes a radiating strip 220 that is located proximate to outer edge 218. Moreover, radiating strip 220 is generally aligned with outer edge 218. In this embodiment, outer edge 218 is straight and radiating strip 220 is parallel to outer edge 218. Notably, antenna radiating element 216 has a major longitudinal axis (which is a horizontal axis in FIG. 6) and a free end 222. These features of antenna radiating element 216 are described in more detail below.

Figure 7:
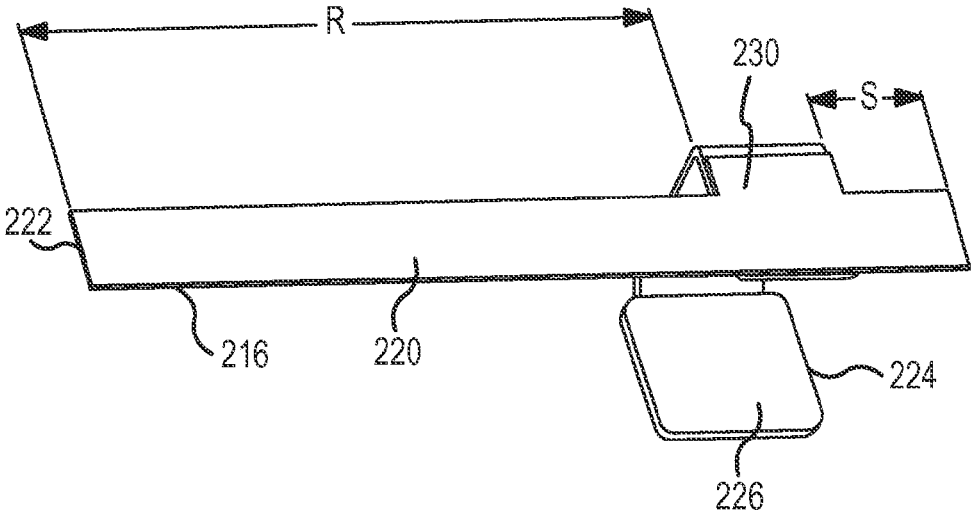
FIGS. 7 and 8 are perspective views of the antenna radiating element and the radiating leg element of an inverted-F antenna structure configured in accordance with an exemplary embodiment.
Figure 8:
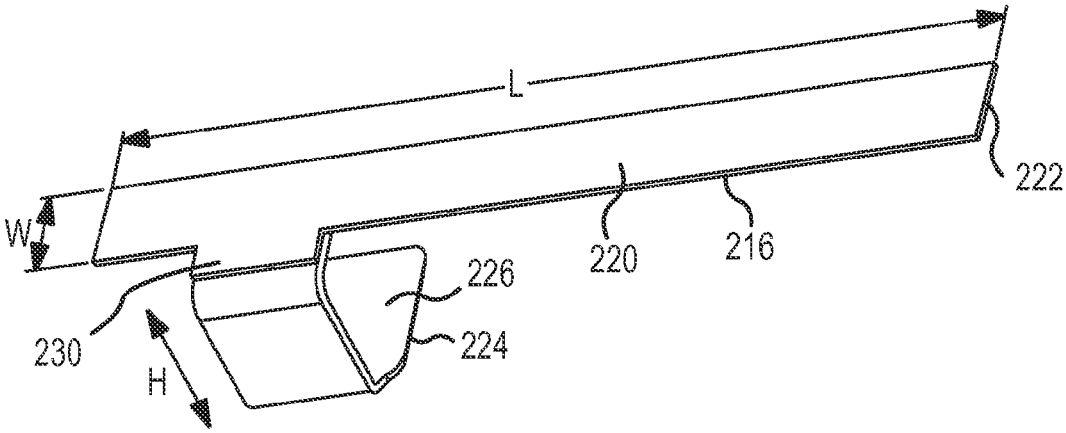
Figure 9:
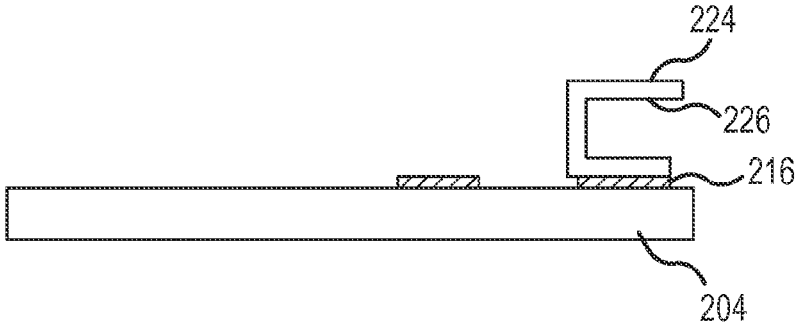
FIG. 9 is a cross sectional view of the antenna radiating element and the radiating leg element as viewed from line 9-9 shown in FIG. 5.

RF antenna arrangement 201 also includes an electrical contact pin 212 and a conductive radiating leg element 224 (also referred to herein as a "conductive antenna leg element"). These features are shown better in FIGS. 7-10, where FIGS. 7 and 8 are perspective views of antenna radiating element 216 and radiating leg element 224, FIG. 9 is a cross sectional view of antenna radiating element 216 and radiating leg element 224 as viewed from line 9-9 (see FIG. 5), and FIG. 10 is a cross sectional view of a portion of electronic device 200 as viewed from line 10-10 (see FIG. 2).

Electrical contact pin 212 is coupled to RF signal transmission line 206. More specifically, the base of electrical contact pin 212 is attached to tab 208 (see FIG. 4) in a manner that accommodates the transmission of RF signals to and from RF signal transmission line 206. For example, electrical contact pin 212 could be soldered to tab 208 to establish a physical and electrical connection. In preferred embodiments, electrical contact pin 212 comprises or is realized as a pogo pin that establishes electrical contact with radiating leg element 224 when primary circuit board 202 is coupled to secondary circuit board 204 using conductive mounting leg 214. Pogo pins are commonly used in the electronics industry; a pogo pin is typically a spring loaded contact that relies upon spring tension to establish and maintain an electrical connection. In this regard, radiating leg element 224 bears down on the pogo pin to establish electrical contact between radiating leg element 224 and the pogo pin when primary circuit board 202 is coupled to secondary circuit board 204. This arrangement is depicted in FIG. 10, where the inward-facing arrows represent the compressive force that is introduced when the circuit boards are attached to conductive mounting leg 214. This compressive force causes radiating leg element 224 to press down on the pogo pin, thus creating a pressured electrical contact without requiring soldering, bonding, welding, etc. Thus, when electronic device 200 is assembled, electrical contact pin 212 facilitates RF signal transmission to and from radiating leg element 224 (i.e., electrical contact pin 212 serves as an RF feed between radiating leg element 224 and RF signal transmission line 206).

Radiating leg element 224 is coupled to (or integrated with) antenna radiating element 216, and it extends in a direction away from secondary circuit board 204 (see FIG. 2 and FIG. 3). Although not required in all embodiments, radiating leg element 224 has a generally C-shaped cross section, as shown in FIG. 9 and FIG. 10. Here, the top (or bottom, depending upon the perspective) section of radiating leg element 224 can be soldered, bonded, or welded to antenna radiating element 216 at the desired location. The middle section of radiating leg element 224 extends from antenna radiating element 216 toward primary circuit board 202 and toward ground reference element 210. In this particular embodiment, the free section 226 of radiating leg element 224 defines a plane that is parallel to the planes defined by primary circuit board 202 and secondary circuit board 204. For this exemplary embodiment, free section 226 is approximately four millimeters square and it extends approximately five millimeters from antenna radiating element 216.

Radiating leg element 224 may be formed as a solid, one-piece, metal contact that is attached (soldered) to antenna radiating element 216 at a designated feed point 228 (FIG. 6). This feed point 228 is located along the major longitudinal axis of antenna radiating element 216. Notably, the distance between feed point 228 and free end 222 is defined as the radiating length of antenna radiating element 216. Thus, the radiating length is dependent upon the location of feed point 228 and the overall length of antenna radiating element 216. In practice, the radiating length is adjusted or selected to achieve the desired frequency tuning of RF antenna arrangement 201. In this regard, a shorter radiating length tunes RF antenna arrangement 201 for higher frequencies, while a longer radiating length tunes RF antenna arrangement 201 for lower frequencies. The position of feed point 228 along antenna radiating element 216 is adjusted or selected to achieve impedance matching (e.g., fifty Ohms). Notably, the position of feed point 228 will also influence the corresponding position of electrical contact pin 212 and the layout of primary circuit board 202. In this manner, the radiating length and feed point 228 of antenna radiating element 216 influence frequency tuning and impedance matching of RF antenna arrangement 201.

One exemplary design of RF antenna arrangement 201 is suitable for a frequency range of about 2400-2483.5 MHz. For this particular implementation, the overall length (L) of antenna radiating element 216 is approximately 21.4 mm and the width (W) of antenna radiating element 216 is approximately 2.0 mm (see FIG. 8). As mentioned above, free section 226 of radiating leg element 224 is about 4.0 mm by 4.0 mm square, and the height (H) of radiating leg element 224 is about 4.9 mm. Referring to FIG. 7, the length (S) of the stub portion of antenna radiating element 216 is about 2.7 mm and the length (R) of radiating strip 220 is about 15.7 mm for this exemplary embodiment. These two sections of antenna radiating element 216 may be separated by a tab 230 that accommodates soldering of radiating leg element 224; the length of this tab 230 is about 3.0 mm in this embodiment. The distance between the two circuit boards (i.e., the height of conductive mounting leg 214) is about 8.0 mm. It should be appreciated that these dimensions can be varied as needed to accommodate different frequencies and/or other RF characteristics. The electromagnetic techniques and theory associated with antenna tuning and adjustment are well known to those familiar with RF devices and, therefore, such techniques and theory will not be presented here.

Figure 11:
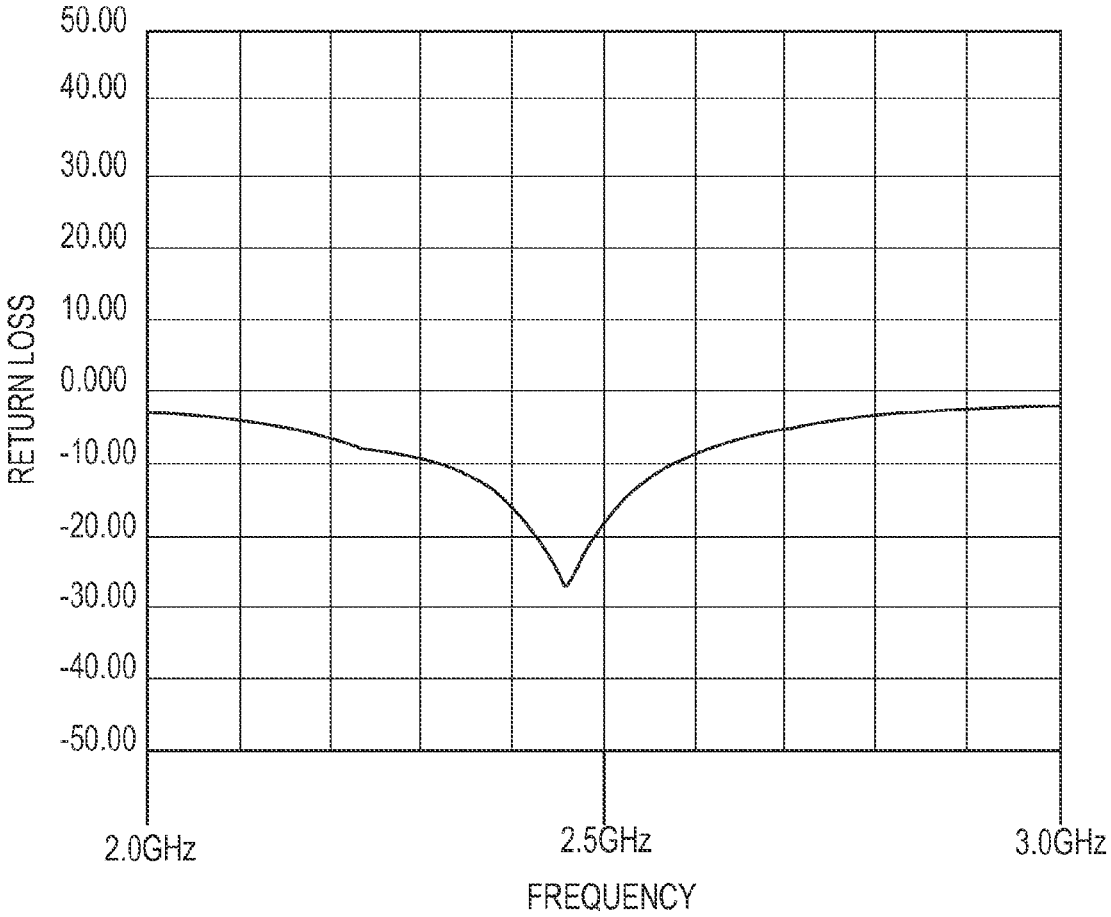
FIG. 11 is a plot of return loss versus frequency for an exemplary embodiment of an inverted-F antenna structure.

FIG. 11 is a plot of return loss (dB) versus frequency (GHz) for an exemplary embodiment of RF antenna arrangement 201 having the dimensions described in the preceding paragraph. As shown in FIG. 11, the return loss is about −16.9 dB at a frequency of about 2.4 GHz, and the return loss is lowest (about −27.5 dB) at a frequency of about 2.46 GHz. This plot illustrates that RF antenna arrangement 201 is well matched across its specified operating band, which indicates good antenna efficiency.

RF antenna arrangement 201 requires less physical space than traditional designs, and eliminates the need for a coaxial RF cable between the two circuit boards. Elimination of the coaxial cable reduces signal loss and, consequently, RF antenna arrangement 201 operates in an efficient manner. Moreover, the use of the chassis as the ground reference for RF antenna arrangement 201 and the use of a pogo pin contact results in a mechanically robust design that is resistant to dropping and shaking.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. An electronic device comprising:

a primary circuit board having a first dielectric substrate and a conductive layer printed on the first dielectric substrate, the conductive layer having defined therein a radio frequency (RF) signal transmission line and a ground reference element that is isolated from the RF signal transmission line;

a secondary circuit board having a second dielectric substrate and a conductive antenna element printed on the second dielectric substrate;

an electrical contact pin coupled to the RF signal transmission line;

a conductive antenna leg element coupled to the conductive antenna element and extending in a direction away from the secondary circuit board; and a conductive mounting leg that physically couples the primary circuit board to the secondary circuit board, and that electrically couples the conductive antenna element to the ground reference element.

2. The electronic device of claim 1, wherein the conductive antenna element, the ground reference element, the electrical contact pin, the conductive antenna leg element, and the conductive mounting leg are associated with an inverted-F antenna structure.

3. The electronic device of claim 1, wherein:

the electrical contact pin comprises a pogo pin; and the pogo pin establishes electrical contact with the conductive antenna leg element when the primary circuit board is coupled to the secondary circuit board using the conductive mounting leg.

4. The electronic device of claim 1, wherein the ground reference element corresponds to chassis ground of the electronic device.

5. The electronic device of claim 1, wherein the RF signal transmission line is realized as a microstrip transmission line formed in the primary circuit board.

6. The electronic device of claim 1, wherein:

the primary circuit board is a main circuit board for the electronic device; and the secondary circuit board is a keypad circuit board for the electronic device.

7. The electronic device of claim 1, wherein the conductive antenna leg element is a solid, one-piece, metal contact that is attached to the conductive antenna element.

8. The electronic device of claim 1, wherein:

the secondary circuit board terminates at an outer edge; and the conductive antenna element comprises a radiating strip proximate to and aligned with the outer edge.

9. A radio frequency (RF) antenna for an electronic device having a primary circuit board with an inward-facing surface, and having a secondary circuit board with an inward-facing surface, the RF antenna comprising:

a radiating element printed on the inward-facing surface of the secondary circuit board;

a radiating leg element coupled to the radiating element and extending from the radiating element toward the inward-facing surface of the primary circuit board;

an electrical contact pin mounted on the primary circuit board, the electrical contact pin in physical and electrical contact with the radiating leg element, and the electrical contact pin facilitating RF signal transmission to and from the radiating leg element;

a ground reference element printed on the inward-facing surface of the primary circuit board; and a conductive mounting leg that physically couples the primary circuit board to the secondary circuit board, and that electrically couples the radiating element to the ground reference element.

10. The RF antenna of claim 9, wherein the radiating element, the radiating leg element, the electrical contact pin, the ground reference element, and the conductive mounting leg are associated with an inverted-F antenna structure.

11. The RF antenna of claim 9, wherein the conductive mounting leg serves as a physical spacer between the primary circuit board and the secondary circuit board.

12. The RF antenna of claim 9, wherein the ground reference element corresponds to chassis ground of the electronic device.

13. The RF antenna of claim 9, wherein:

the secondary circuit board comprises a dielectric substrate and a conductive metal layer formed on the inward-facing surface of the secondary circuit board; and the radiating element is formed from the conductive metal layer.

14. The RF antenna of claim 9, wherein:

the primary circuit board comprises a dielectric substrate and a conductive metal layer formed on the inward-facing surface of the primary circuit board; and the ground reference element is formed from the conductive metal layer.

15. The RF antenna of claim 9, wherein:

the radiating element has a major longitudinal axis and a free end;

the radiating leg element is coupled to the radiating element at a feed point along the major longitudinal axis;

the radiating element has a radiating length defined between the feed point and the free end; and the radiating length and the feed point influence tuning and impedance matching of the RF antenna.

16. A radio frequency (RF) antenna arrangement for an electronic device, the RF antenna arrangement comprising:

a first circuit board having a first inward-facing surface and a conductive ground reference element formed on the first inward-facing surface;

a second circuit board having a second inward-facing surface and a conductive antenna radiating element formed on the second inward-facing surface;

a conductive radiating leg element for the conductive antenna radiating element, the conductive radiating leg element extending away from the second inward-facing surface and toward the first inward-facing surface;

an electrical contact pin mounted on the first circuit board, the electrical contact pin in physical and electrical contact with the conductive radiating leg element, and the electrical contact pin facilitating RF signal transmission to and from the conductive radiating leg element; and a conductive ground leg element located between the first circuit board and the second circuit board, the conductive ground leg element electrically coupling the conductive antenna radiating element to the conductive ground reference element.

17. The RF antenna arrangement of claim 16, wherein the conductive ground leg element physically couples the first circuit board to the second circuit board.

18. The RF antenna arrangement of claim 17, wherein:

the electrical contact pin comprises a pogo pin; and the conductive radiating leg element bears down on the pogo pin to establish electrical contact between the conductive radiating leg element and the pogo pin when the first circuit board is coupled to the second circuit board using the conductive ground leg element.

19. The RF antenna arrangement of claim 16, wherein the conductive antenna radiating element, the conductive ground reference element, the conductive radiating leg element, the electrical contact pin, and the conductive ground leg element together form an inverted-F antenna structure.

20. The RF antenna arrangement of claim 16, wherein the conductive ground reference element corresponds to chassis ground of the electronic device.

* * * * *